US005476745A

United States Patent [19]

Nakamura et al.

[11] Patent Number: 5,476,745

[45] Date of Patent: Dec. 19, 1995

[54] PROCESS FOR PRODUCING TONER PARTICLES

[75] Inventors: Tatsuya Nakamura, Tokyo; Ichiro Ohsaki; Takayuki Nagatsuka, both of Yokohama; Makoto Kanbayashi, Kawasaki; Tatsuhiko Chiba, Tokyo, all of Japan

[73] Assignee: Canon Kabushiki Kaisha, Tokyo, Japan

[21] Appl. No.: 379,119

[22] Filed: Jan. 27, 1995

Related U.S. Application Data

[63] Continuation of Ser. No. 941,790, Sep. 8, 1992, abandoned.

[30] Foreign Application Priority Data

Sep. 9, 1991 [JP] Japan ..... 3-255908
Sep. 10, 1991 [JP] Japan ..... 3-257198

[51] Int. Cl.[6] ..... G03G 5/00
[52] U.S. Cl. ..... 430/137; 430/109
[58] Field of Search ..... 430/137, 109

[56] References Cited

U.S. PATENT DOCUMENTS

| | | | |
|---|---|---|---|
| 2,297,691 | 10/1942 | Carlson | 95/5 |
| 4,282,304 | 8/1981 | Bayley | 430/137 |
| 4,558,108 | 12/1985 | Alexandru et al. | 526/340 |
| 4,816,366 | 3/1989 | Hyosu et al. | 430/137 |
| 4,971,879 | 11/1990 | Kimura et al. | 430/106.6 |
| 5,130,219 | 7/1992 | Mori et al. | 430/106 |
| 5,130,220 | 7/1992 | Nakamura et al. | 430/109 |

FOREIGN PATENT DOCUMENTS

| | | |
|---|---|---|
| 0266697 | 5/1988 | European Pat. Off. . |
| 36-10231 | 7/1961 | Japan . |
| 47-51830 | 12/1972 | Japan . |
| 51-14895 | 5/1976 | Japan . |
| 53-17735 | 2/1978 | Japan . |
| 53-17736 | 2/1978 | Japan . |
| 53-17737 | 2/1978 | Japan . |
| 64-70765 | 3/1989 | Japan . |
| 1-303450 | 12/1989 | Japan . |

OTHER PUBLICATIONS

Patent Abstracts of Japan, vol. 12, No. 194 (P–713) [3041], Jun. 7, 1988.
Patent Abstracts of Japan, vol. 15, No. 391 (P–1259) Oct. 3, 1991.

*Primary Examiner*—S. Rosasco
*Attorney, Agent, or Firm*—Fitzpatrick, Cella, Harper & Scinto

[57] ABSTRACT

The present invention provides a process for producing a toner having little remaining polymerizable monomer in it by suspension polymerization. During the latter half of the polymerization reaction, the remaining polymerizable monomers and the aqueous medium are evaporated or removed while supplying the aqueous medium, saturated vapor of the aqueous medium, saturated vapor of a water-soluble solvent, or water-soluble gas to maintain the ratio of solid-liquid constant.

36 Claims, No Drawings

PROCESS FOR PRODUCING TONER PARTICLES

This application is a continuation of application Ser. No. 07/941,790 filed Sep. 8, 1992, now abandoned.

BACKGROUND OF THE INVENTION

1. Field of the invention

The present invention relates to a process for producing a toner used in a process by which a latent image is converted to a visible image.

2. Related Background Art

There is an image forming method in which an electrical latent image or magnetic latent image on a recording member is converted to a visible image by attracting electrodetective or magnetosensitive fine particles called a toner.

As electrophotography, which is a typical example thereof, various methods have been conventionally known, as disclosed, for example, in U.S. Pat. No. 2,297,691. In general, in this electrophotography, an electrostatic latent image is formed on a photosensitive member, utilizing a photoconductive material and according to various means, and subsequently the latent image is developed using a toner to form a toner image. Then the toner image is transferred to a transfer medium like paper if necessary, followed by fixing using a fixing means such as heat, pressure or solvent vapor. A copy is thus obtained.

Usually toners used for such purposes are produced by mixing and melting a coloring material comprised of a dye or pigment and a magnetic material in a thermoplastic resin and uniformly dispersing the coloring material, followed by pulverization and classification to obtain a toner having a given particle diameter. This method is relatively stable as a technique and can enjoy relatively easy control of the materials and process.

This method, however, is poor in energy efficiency, since the materials are melted together with a binder resin to mix and bind, and further the molten product is cooled, and then mechanically pulverized. Moreover, the resulting toner tends to have a broad range of particle size since fine particles are produced by the mechanical pulverization. Consequently as a step following the pulverization the toner must be classified, in order to obtain a fraction having the desired particle size distribution. This makes it difficult to obtain a high product yield. In order to solve such problems, a process in which the toner is produced by what is called suspension polymerization has been proposed as a new production process.

For example, Japanese Patent Publications No. 36-10231, No. 47-51830 and No. 51-14895 and Japanese Laid-Open Patent Application No. 53-17735, No. 53- 17736 and No. 53-17737 disclose processes for producing a toner by the suspension polymerization. In the suspension polymerization, materials that are required to be contained in a toner as exemplified by a binder resin, a colorant such as a dye or pigment, a magnetic material, carbon black, a charge control agent and a release agent such as wax or silicone oil are uniformly dissolved or dispersed in a polymerizable monomer optionally together with a polymerization initiator and a dispersant to form a polymerizable composition, and this polymerizable composition is put in an aqueous continuous phase containing a dispersion stabilizer to form fine particles using a dispersion machine, then the particles being solidified by polymerization reaction so that toner particles with the desired particle diameters can be obtained in one step when the polymerization is completed.

This suspension polymerization enables omission of not only the melting step and pulverization step but also the subsequent classification step, and can be greatly effective for energy saving, time shortening, improvement of process yield, and cost reduction.

In suspension polymerization, including suspension polymerization for toners, increase in viscosity of its reaction system tends to occur as the polymerization proceeds, so that it becomes difficult for radicals and polymerizable monomers to move and hence polymerizable monomer components tend to be trapped in a large quantity in the polymer. In particular, for the suspension polymerization toners, more unreacted polymerizable monomers tend to remain because there is a large amount of components such as a dye or pigment (in particular, carbon black), charge control agent and magnetic material which may inhibit the polymerization. Not limiting to the polymerizable monomers, any component in the toner that may act as a solvent to the binder resin, may cause a lowering of fluidity of the toner making image quality poor, and also may cause a lowering of blocking resistance. Besides the toner performances, phenomena of deterioration of a photosensitive member other than the toner adhesion to the drum, such as memory ghost and unfocused images, may occur especially when an organic semiconductor is used as the photosensitive member. Besides such matters that concern the performances of products, there is a problem that the polymerizable monomer component evaporates during fixing to give off an offensive odor.

A means for decreasing the quantity of remaining polymerizable monomers may firstly be to improve polymerization conversion rate of the polymerizable monomers. As a method therefor, it is very effective to increase the amount of a polymerization initiator during polymerization, but the molecular weight distribution of the resulting toner shifts to a lower molecular weight making it impossible to obtain the desired molecular weight distribution (for styrene-acrylic types, molecular weights ranging from 10,000 to 50,000 give a good balance between fixing-starting temperature and fixing strength or toner strength). When plural kinds of polymerization initiators having different half-life are used so that a large amount of the polymerization initiators is present as a whole but radical species generated in the initiation phase is reduced, the shift to a low molecular weight and broadening the molecular weight distribution (this is important when heat-roller fixing is employed) can be effectively prohibited, but after all it can not overcome the problem of viscosity and can not be said to be fully satisfactory.

As methods for decreasing the viscosity of polymers and increasing the mobility of polymerizable monomers, followings can be contemplated: (i) add a solvent, (ii) add a plasticizer, (iii) add a chain transfer agent and (iv) raise temperature. Methods (i) and (ii), however, leave a problem in the toner when polymerization is completed. Method (iii) controls the formation of high molecular weight polymers that effect the viscosity without decreasing the quantity of radicals, but at present no satisfactory results has been obtained. In method (iv), polymers are melted by heat and at the same time thermal polymerization proceeds, where the polymerizable monomers can be more effectively consumed when a polymerization initiator which decomposes at a high temperature to produce radical species is present. This method, however, has difficulties in stabilizing dispersion and preventing agglomeration of polymerization toners.

Now, other than the consumption of polymerizable monomers by increasing the degree of polymerization, one may contemplate to collect polymerizable monomer vapor from a suspension to expell the polymerizable monomers remaining in the toner from the toner system, thereby to decrease the quantity of remaining polymerizable monomers. This, however, takes a very long time since this means the diffusion of an organic solvent through water. If the suspension system is vigorously stirred to increase the diffusion area in order to shorten time, air involved into the system causes bubbles, and toner particles adhered to the bubbles may come up to the surface of the suspension. Hence, there is a danger of producing a faulty toner because of agglomeration of toner particles and changes in polymerization conditions.

As a method of shortening the process time, Japanese Patent Application Laid-open No. 1-70765 discloses a method for producing a resin for a toner, in which, after suspension polymerization, the system is heated at a temperature higher than the Tg of the resulting resin to evaporate water in a quantity of 5% to 50% by weight based on the quantity of water at the time of completion of polymerization. This method certainly makes it possible to reduce the polymerizable monomers remaining in the resin in a short time, but consumes a large amount of energy. For the production of the polymerization toner, it is required a strict control of particle size, different from the resin for a toner to be obtained in the Japanese Laid-Open Patent Application No. 1-70765, in view of the prevention of agglomeration of particles. Thus, it is difficult to employ this method as it is.

As another method of shortening the production time, Japanese Laid-Open Patent Application No. 1- 303450 discloses a method in which a polymerization product obtained by suspension polymerization is immersed and stirred during polymerization in an organic solvent capable of dissolving monomer components but not dissolving polymer components, and thereafter the polymerization product is collected from the solvent, followed by drying. This method, however, has a disadvantage that any component soluble in the organic solvent can not be added to the toner.

SUMMARY OF THE INVENTION

An object of the present invention is to provide a process for producing a toner, that have solved the problems as discussed above.

Another object of the present invention is to provide a process for producing a polymerization toner having a superior developing performance and less remaining polymerizable monomers.

Still another object of the present invention is to provide an efficient process for producing a toner having a narrow particle size distribution, a high fluidity and a good blocking resistance, promising a good image quality.

The objects of the present invention can be achieved by a process for producing toner particles, comprising the steps of;

suspending in an aqueous medium a polymerizable monomer composition containing a polymerizable monomer, to carry out granulation;

subjecting particles of the granulated polymerizable monomer composition to suspension polymerization; and, while adding to the suspension an aqueous medium, a saturated vapor of an aqueous medium, a saturated vapor of a water-soluble solvent, or a water-soluble gas, removing the remaining polymerizable monomer, the aqueous medium of said suspension, and the aqueous medium, saturated vapor of an aqueous medium, saturated vapor of a water-soluble solvent, or water-soluble gas added, at the latter half of said suspension polymerization period or after the completion of reaction.

DESCRIPTION OF THE PREFERRED EMBODIMENTS

In a suspension state, toner particles can be floated by a slight force which can avoid agglomeration even when a heat is applied to effect volatilizing of remaining polymerizable monomers. Moreover, since polymerization proceeds first at the interface, low-molecular weight components can be internally held. When the suspension medium is an aqueous medium, low-polar components and low-surface energy components that tend to particularly lower the developing performance of the toner can be internally held. Therefore it is desirable to carry out the treatment in a suspended state as far as possible. On the other hand, the vapor of polymerizable monomers slowly diffuses in suspension polymerization, and an attempt to increase the diffusion rate may bring about a loss of suspension stability as previously stated.

As a result of extensive studies, the present inventors have discovered that a toner having less remaining monomers, a sharp particle size distribution and a superior fluidity and blocking resistance, promising a good image quality, can be efficiently obtained by suspending a polymerizable monomer composition in an aqueous medium, to carry out granulation; subjecting particles of the granulated polymerizable monomer composition to suspension polymerization; and, while adding to the suspension an aqueous medium, a saturated vapor of an aqueous medium, a saturated vapor of a water-soluble solvent, or a water-soluble gas, removing the remaining polymerizable monomer with the aqueous medium of said suspension, and the added aqueous medium, saturated vapor of an aqueous medium, saturated vapor of a water-soluble solvent, or water-soluble gas, at the latter half of said suspension polymerization period or after the completion of reaction.

When the aqueous medium of the suspension is evaporated to remove the monomers remaining in the particles, the ratio of solid-to-liquid increases, so that coalescence of particles and melt-adhesion of particles to the wall of a reaction vessel may occur. When an aqueous medium is added to the suspension to maintain the ratio of solid-to-liquid constant, and the aqueous medium and the remaining monomer are simultaneously evaporated from the suspension containing the remaining polymerizable monomers and the aqueous medium including newly added medium, whereby the toner having a sharp particle size distribution and a superior fluidity and blocking resistance to promise a good image quality, can be obtained in a good efficiency.

Saturated vapor of an aqueous medium may also be added in the suspension at the latter half of the suspension polymerization or after the completion of reaction, whereby the gas-liquid interface can be enlarged and the vapor of polymerizable monomers can be efficiently sent off from the polymerization system. Since the gaseous phase and the aqueous medium are of the same kind, bubbles do not remain long and the stability of the suspension system is not disturbed.

Also when saturated vapor of a water-soluble solvent, or a water-soluble gas is added in the suspension in place of the saturated vapor of the aqueous medium, the gas-liquid interface can be enlarged and the vapor of polymerizable monomers can be send off outside the polymerization system at an accelerated rate. Meanwhile, the gaseous phase is shortly absorbed into the suspension, the vapor condenses to a reduced volume, or the strength of bubbles decreases and the bubbles become readily breakable as the vapor is absorbed into the water. Hence the bubbles do not remain long and the stability of the suspension system is not disturbed.

As a method to remove the aqueous medium, there is a method of evaporating the aqueous medium corresponding to 5% to 100% by weight of the suspension while heating it at a temperature higher than the top temperature of endothermic peaks measured using a differential scanning calorimeter (DSC).

The amount of removed aqueous medium should be at least 5% by weight of the suspension. If it is less than 5%, the amount of remaining monomers in the toner can not be sufficiently reduced the other hand, if it is more than 100% by weight of the suspension, no more reduction of the amount of the remaining monomers can be recognized. Removal of the aqueous medium in a quantity of 100% by weight is enough to remove the remaining monomers, to achieve the objects of the present invention.

When the evaporation temperature can not be raised in view of physical properties of toner particles, the aqueous medium may be evaporated under reduced pressure and/or with sonication. This makes it possible to avoid the coalescence of particles and melt-adhesion of particles to the wall of the reaction vessel. Sonication expels the remaining monomers in the toner efficiently from the particles.

In this case also, the aqueous medium may preferably be evaporated at a temperature higher than the top temperature of the endothermic peaks if possible. This is because the monomers remaining in the toner may be confined in the toner if it is evaporated at a temperature lower than the top temperature of the endothermic peaks, making it difficult to remove the remaining monomers.

In the process of the present invention, it is preferred that saturated vapor of a fresh aqueous medium, generated outside the system, is introduced into the aqueous medium when the polymerization conversion rate has reached at least 90%, concomitantly removing the gaseous phase vapor and polymerizable monomers from the reaction system, until the remaining polymerizable monomers are finally in a quantity of not more than 1,000 ppm, and preferably not more than 100 ppm taking care of giving off no offensive odor. Good results can be obtained when the saturated vapor of an aqueous medium is fed to the whole suspension in the form of minute bubbles through a porous tube or the like. This reaction operation should be controlled so that the reaction system does not boil. In the present invention, the polymerization conversion rate refers to the proportion of the consumed monomers to the initial polymerizable monomers after the polymerization reaction.

When the saturated vapor of a water-soluble solvent or the dried water-soluble gas is used in place of the saturated vapor of an aqueous medium, they also should preferably be introduced into the aqueous medium in the same way and the same care should be taken. As the water-soluble solvent used in the present invention, various solvents soluble in water can be used. From the viewpoint of the present invention, those having a high solubility in water and a high volatility are preferable, including lower alcohols such as methanol, ethanol and propanol and lower ketones such as acetone, which are advantageous because of their free miscibility with water and their low boiling points. The water-soluble gas may include acidic gases such as carbonic acid gas and basic gases such as ammonia. Good results can be obtained when such water-soluble solvent vapor or water-soluble gas is fed to the entire suspension in the form of minute bubbles through a porous tube or the like. This reaction operation should be controlled so that the reaction system does not boil. It is desirable to supply water in an amount corresponding to the water evaporated during operation so as to maintain the quantity of water.

The polymerizable monomer that constitutes the polymerizable monomer system or composition, and toner properties-providing agents such as a colorant may include the following.

The polymerizable monomer may include monomers as exemplified by styrene monomers such as styrene, o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide.

Any of these monomers may be used alone or in combination. Of the above monomers, it is preferable from the viewpoint of developing performance and durability of the toner to use styrene or a styrene derivative alone or in combination with other monomer(s).

In the present invention, a resin having a polar group may be added to the monomer system to carry out the polymerization. Examples of the polar resin usable in the present invention are shown below.

(1) A cationic polymer may include polymers of nitrogen-containing monomers as exemplified by dimethylaminoethyl methacrylate and diethylaminoethyl methacrylate, or copolymers thereof with monomers such as styrene and an unsaturated carboxylic acid ester.

(2) An anionic polymer may include polymers of nitrile monomers such as acrylonitrile, halogen type monomers such as vinyl chloride, unsaturated carboxylic acid monomers such as acrylic acid and methacrylic acid, unsaturated dibasic acid monomers, unsaturated dibasic acid anhydride monomers or nitro monomers, or copolymers thereof with styrene monomers. These polar resins can improve the blocking resistance of the toner by localizing near the toner particle surfaces.

In the present invention, other resin may be added to the monomer system to carry out the polymerization. For example, when it is desired to incorporate a monomer component containing an amino group, a carboxylic acid, a hydroxyl group, a sulfonic acid group or a glycidyl group which are water-soluble in the form of a monomer and cannot be used in water-based suspensions causing emulsion polymerization, it is possible to use any of them in the form of a random copolymer, block copolymer or graft copolymer thereof with styrene or ethylene. A polymer with a molecular weight outside the range of the molecular weight of the toner obtained by polymerization of monomers may be dissolved in the monomers to carry out polymerization, whereby a toner with a broad molecular weight distribution and a high offset resistance can be obtained.

As the colorant used in the present invention, known colorants can be used, including dyes such as carbon black, black iron oxide, C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6, and pigments such as chrome yellow, cadmium yellow, mineral first yellow, navel yellow, Naphthol Yellow S, Hanza Yellow G, Permanent Yellow NCG, Tartrazine Lake, molybdenum orange, Permanent Orange GTR, Benzidine Orange G, cadmium red, Permanent Red 4R, Watchung Red calcium salt, Brilliant Carmine 3B, Fast Violet B, Methyl Violet Lake, prussian blue, cobalt blue, Alkali Blue Lake, Victoria Blue Lake, quinacridone, Rhodamine Lake, Phthalocyanine Blue, Fast Sky Blue, Pigment Green B, Malachite Green Lake and Final Yellow Green. Since in the present invention the toner is obtained by polymerization, attention must be paid to the polymerization inhibitory action and aqueous-phase migration properties inherent to the colorant. The colorant should more preferably be previously subjected to surface modification, for example, hydrophobic treatment using a material free from inhibition of polymerization. In particular, many of dyes and carbon black have the polymerization inhibitory action and hence attention must be paid when they are used. A preferable method for the surface treatment of the dyes may include a method in which polymerizable monomers are polymerized in the presence of any of these dyes.

With regard to the carbon black, it is preferable, besides the same treatment for the dyes, to carry out grafting using a material capable of reacting with surface functional groups of the carbon black, as exemplified by polyorganosiloxane or polyethylene glycol. Most of other pigments have not strong polymerization inhibitory action as the carbon black, but preferably should be similarly treated considering the dispersion in polymerizable monomers.

In the present invention, a magnetic material may be included to give a magnetic toner, which material also may preferably be used after it has been subjected to surface treatment.

In the present invention, a charge control agent may have been added in the toner materials to control the chargeability of the toner. The charge control agent should preferably have neither polymerization inhibitory action nor aqueous-phase migrating properties. For example, a positive charge control agent may include Nigrosine dyes, triphenylmethane dyes, quaternary ammonium salts, amine type compounds or polymers, and imine type compounds or polymers. A negative charge control agent may include metal complex salts of salicylic acid or an alkyl salicylic acid, gold-containing monoazo dyes, polymers having a carboxylic acid or sulfonic acid functional group, and humic acids such as nitrohumic acid and salts thereof.

In the suspension polymerization of the present invention, a low-molecular weight polymer such as wax, a plasticizer, a liquid rubber, a low-temperature fluidizing component such as silicone oil, and a low surface energy material may be contained in the toner to improve low-temperature fixing performance, or release properties can be improved when the toner is used in combination with a heat-roller fixing assembly.

The wax may include, for example, paraffin waxes, polyolefin waxes, modified products of these as exemplified by oxides and grafted products, as well as higher fatty acids and metal salts thereof, higher aliphatic alcohols, higher aliphatic esters, and aliphatic amide waxes. These waxes should be those having a softening point of from 30° to 130° C., preferably from 40° to 120° C., and more preferably from 50° to 100° C., as measured by the ring-and-ball method (JIS K2531). The wax should preferably be dissolved in the polymerizable monomers. If the softening point is below 30° C., it becomes difficult to make the wax retained in the toner. If it is above 130° C., it becomes difficult for the wax to be dissolved in the polymerizable monomers making its dispersion non-uniform, increasing the viscosity of the polymer composition and thus making particle size distribution broader during granularion. Thus, such temperatures are not preferable. The wax may be added usually in an amount of from 1 part to 100 parts by weight based on 100 parts by weight of the polymerizable monomers. Its use in an amount more than 10 parts by weight brings about satisfactory release properties and low-temperature fixing performance.

As other means for improving release properties, silicone oil may be used alone or in combination. The silicone oil used in the present invention may preferably have a viscosity in the range of from 100 to 100,000 cSt at 25° C. Silicone oil with a viscosity outside this range may cause a lowering of release effect and bring about the same problems as in the wax in respect of its retension in toner and granulation performance. It is suitable for the silicone oil to be used usually in an amount of from 0.1 part to 10 parts by weight based on 100 parts by weight of the polymerizable monomers. Its use in an amount more than 10 parts by weight is unnecessary since the release properties are improved no more, only making image surfaces sticky.

The polymerization initiator used in the present invention may have a half-life period (hereinafter simply "t ½") of from 0.5 hour to 30 hours, which may be added in an amount of from 0.5% to 20% by weight of the polymerizable monomers to carry out polymerization reaction, so that a polymer having a distribution peak of molecular weight between 10,000 and 100,000 can be obtained and the desired strength and appropriate melt properties can be obtained. As examples of the polymerization initiator, it may include azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile, and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

In the present invention, a cross-linking agent may be used, which may preferably be added in an amount of from 0.001% to 15% by weight.

The additives used in the present invention for the purpose of providing various properties may preferably have a particle diameter of not more than 1/10 of the weight average diameter of the toner particles. This particle diameter of the additives is meant to be an average particle diameter measured using an electron microscope by observing surfaces of toner particles. As these properties-providing additives, for example, the following can be used.

1) Fluidity-providing agents: Metal oxides such as silicon oxide, aluminum oxide and titanium oxide, carbon black, and carbon fluoride. These may more preferably be subjected to hydrophobic treatment.

2) Abrasives: Metal compounds including metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate.

3) Lubricants: Fluorine resin powders such as vinylidene fluoride and polytetrafluoroethylene, and fatty acid metal salts such as zinc stearate and calcium stearate.

4) Charge controlling particles: Metal oxides such as tin oxide, titanium oxide, zinc oxide, silicon oxide and aluminum oxide, and carbon black.

Any of these additives may be used in an amount of from 0.1 part to 10 parts by weight, and preferably from 0.1 part to 5 parts by weight, based on 100 parts by weight of the toner particles. These additives may be used alone or in combination of plural ones.

The toner produced by the present invention may preferably have a weight average particle diameter of from 2 to 12 μm. It may more preferably have a weight average particle diameter of from 4 to 9 μm.

In the toner production process of the present invention, the toner composition described above, i.e., a monomer system comprising polymerizable monomers, and appropriately added thereto the components necessary for the toner, such as a colorant, a release agent, a plasticizer, a binder, a charge control agent, a cross-linking agent and a magnetic material, and other additives as exemplified by an organic solvent or dispersing agent added to decrease the viscosity of the polymer formed by polymerization, uniformly dissolved or dispersed by means of a dispersion machine such as a homogenizer, a ball mill, a colloid mill or an ultrasonic dispersion machine, is suspended in the aqueous medium containing a dispersion stabilizer. At this time, it is more preferable to make the toner particles have the desired size in one step by the use of a high-speed stirrer or a high-speed dispersion machine such as an ultrasonic dispersion machine, since thereby the particle diameter of resulting toner particles can have a sharp distribution. The polymerization initiator may be added at the same time when other additives are added in the polymerizable monomers, or may be mixed right before the monomer composition is suspended in the aqueous medium. It is also possible to add a polymerization initiator having been dissolved in the polymerizable monomers or a solvent, immediately after granulation and before the polymerization reaction is initiated.

After the granulation, stirring are carried out using a conventional stirrer, to such an extent that the state of particles is maintained and the particles can be prevented from floating or settling.

After the reaction has been completed, while adding to the suspension an aqueous medium, a saturated vapor of an aqueous medium, a saturated vapor of a water-soluble solvent, or a water-soluble gas, the remaining polymerizable monomer, the aqueous medium of said suspension, and the added aqueous medium, saturated vapor of an aqueous medium, saturated vapor of a water-soluble solvent, or water-soluble gas are evaporated or removed. Then the dispersion stabilizer is removed, and the toner particles formed are collected by washing and filtration, followed by drying. In the suspension polymerization, water may preferably be used as a dispersion medium (the aqueous medium) usually in an amount of from 300 to 3,000 parts by weight based on 100 parts by weight of the monomer system.

In the suspension polymerization carried out in the present invention, any known surface active agent, organic dispersant or inorganic dispersant can be used as the dispersion stabilizer. Of these, the inorganic dispersant can be preferably used since it does not tend to produce harmful ultrafine powder, it is stable even when reaction temperatures are changed, because the dispersion stability is due to its steric hindrance action, it is easy to wash and it hardly affects the toner adversely. As examples of such an inorganic dispersion stabilizer, it may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; inorganic hydroxides such as calcium hydroxide, magnesium hydroxide and aluminum hydroxide; and inorganic oxides such as silica, bentonite and alumina.

Any of these inorganic dispersant may preferably be used alone in an amount of from 0.2 part to 20 parts by weight based on 100 parts by weight of the polymerizable monomers. Although such inorganic dispersant does not tend to form ultrafine particles, but may be a little disadvantageous for obtaining fine toner particles. Hence, it may be used in combination with from 0.001 to 0.1 part by weight of a surface active agent.

The surface active agent may include, for example, sodium dodecylbenzenesulfate, sodium tetradecylsulfate, sodium pentadecylsulfate, sodium octylsulfate, sodium oleate, sodium laurate, sodium stearate and potassium stearate.

When the inorganic dispersant is used, they can be used without any treatment, but to obtain finer particles, the inorganic dispersant are dispersed in an aqueous medium. For example, in the case of calcium phosphate, an aqueous sodium phosphate solution and an aqueous calcium chloride solution may be mixed with high-speed stirring, whereby water-insoluble calcium phosphate can be formed and more uniform and finer dispersion can be carried out. Water-soluble sodium chloride is simultaneously formed as a by-product. Presence of such a water-soluble salt in the aqueous medium is preferable since it prohibits the polymerizable monomers from dissolving in water and prohibits the formation of an ultrafine toner by emulsion polymerization. Because the salt becomes an obstacle when the remaining polymerizable monomers are removed at the termination of polymerization reaction, it is preferable to change the aqueous medium or carry out desalting using an ion-exchange resin. The inorganic dispersant can be almost completely removed by dissolving it with an acid or alkali after the polymerization has been completed.

In the polymerization step, the polymerization may be carried out at a polymerization temperature set at 40° C. or above, usually from 50° to 90° C. When polymerization carried out within this temperature range, the release agent, wax and so forth that should be enclosed inside, precipitate by phase separation, so that they can be internally held more completely. In order to make the molecular weight low, it is possible to use a method in which the temperature is temporarily set at 130° C. or above during the polymerization initiation to increase initial concentration of radicals, and thereafter the temperature is set at the aforesaid temperature to continue the polymerization reaction. In order to consume the remaining polymerizable monomers, it is possible to raise the reaction temperature up to 90° to 150° C. at the termination period of polymerization reaction. The phase separation can be accelerated when a polar material is present together in the monomer system at this stage. In particular, a polar high-molecular weight polymer is more effective.

Under conditions as described above, the conversion rate increases almost linearly to Above polymerization rate of 90% at which the toner becomes solid, the degree of polymerization increases slowly, and at a polymerization conversion rate of or more it increases very slowly. Since at this stage the toner is already in the range of sufficient molecular weights, it is more efficient to proceed to remove polymerizable monomers. The amount of polymerizable monomers finally remaining in the toner should be not more than 1,000 ppm, and preferably not more than 100 ppm.

The polymerization conversion rate, the quantity of remaining polymerizable monomers and the quantity of remaining organic solvent are determined using gas chromatography (GC) measuring the peak area of each substance, under the following conditions. For the measurement, after a polymerization inhibitor is added to the sample, the samples is dried over anhydrous magnesium sulfate, and dissolved in 4 ml of THF.

| - GC conditions - | |
|---|---|
| Measuring apparatus: | Shimadzu GC-15A (with capillaries) |
| Carrier: | $N_2$, 2kg/cm$^2$ 50 ml/min. |
| | Split 10 ml/13s |
| Columns: | ULBON HR-1 50 m × 0.25 mm in diam. |
| Temperature setting: | |
| | 50° C., maintained for 5 min. |
| | ↓ 10° C./min. |
| | 100° C. |
| | ↓ 20° C./min. |
| | 200° C., maintained. |
| Amount of sample: | 2 μl |
| Standard: | Toluene |

In the present invention, the particle size is measured using Coulter counter TA-II (manufactured by Coulter Electronics, Inc.) as a measuring device. An interface (manufactured by Nikkaki k.k.) that outputs number distribution and volume distribution and a personal computer CX-1 (manufactured by Canon Inc.) are connected. As an electrolytic solution, an aqueous 1% NaCl solution is prepared using first-grade sodium chloride.

As a dispersant, from 0.1 to 5 ml of a surface active agent, preferably an alkylbenzene sulfonate, is added to from 100 to 150 ml of the above aqueous electrolytic solution, to which from 0.5 to 50 mg of a sample to be measured is further added, followed by dispersion for about from 1 to 3 minutes using an ultrasonic dispersion device. A sample solution is thus prepared.

The particle size distribution of particles of from 2 μm to 40 μm is measured by means of the above Coulter counter TA-II, using an aperture of 100 μm. On the basis of the number distribution and volume distribution, the length average diameter, weight average diameter and their variation coefficients are calculated using the central value of the measured channel as a representative diameter.

The endothermic peak top temperature in the present invention is measured using DSC-7 (manufactured by Perkin Elmer Co.,), raising temperatures at a rate of 10° C./min, and determined from a peak at which the maximum absorption of heat is indicated in the DSC curve of the first temperature rise.

The process for producing toner particles according to the present invention can produce toner particles having a small quantity of polymerizable monomers remaining in the toner, having a sharp particle size distribution and capable of providing good images without causing an offensive odor during the fixing of images and a lowering of image quality.

The present invention will be specifically described below by giving Examples.

EXAMPLE 1

Into 709 g of ion-exchanged water, 451 g of an aqueous 0.1M-$Na_3PO_4$ solution was introduced, and the mixture was heated to 60° C., followed by stirring at 12,000 rpm using a TK-type homomixer (manufactured by Tokushu Kika Kogyo Co., Ltd.). Then, 67.7 g of an aqueous O.1M-$CaCl_2$ solution was added thereto little by little to give an aqueous medium containing $Ca_3(PO_4)_2$.

Following formulation:

| | |
|---|---|
| Styrene | 170 g |
| 2-Ethylhexyl acrylate | 30 g |
| C.I. Pigment Blue 15:3 | 10 g |
| Paraffin wax (m.p.: 70° C.) | 30 g |
| Di-tert-butylsalicylic acid metal compound | 5 g |

was heated to 60° C., and was uniformly dissolved and dispersed with stirring at 12,000 rpm using a TK-type homomixer (manufactured by Tokushu Kika Kogyo Co., Ltd.). As polymerization initiators, 10 g of 2,2'azobis(2,4-dimethylvaleronitrile) and 1 g of dimethyl 2,2'-azobisisobutyrate were dissolved to give a polymerizable monomer system. The polymerizable monomer system was introduced into the above aqueous medium, followed by stirring using the TK homomixer at 10,000 rpm for 20 minutes at 60° C. in an $N_2$ atmosphere to carry out granulation of the polymerizable monomer system. Thereafter, while stirring with paddle stirring blades, the reaction was carried out at 60° C. for 3 hours, and then the liquid temperature was raised to 80° C. to carry out the reaction for further 10 hours.

After the polymerization reaction was completed, water corresponding to 100% by weight of the suspension was evaporated while the same amount of water was added to maintain the liquid quantity of the suspension, under reduced pressure of 200 mmHg, with sonication (20 kHz, 30 W) and in an oil bath at temperature of 150° C. Thereafter, the system was cooled, hydrochloric acid was added to dissolve the $Ca_3(PO_4)_2$, followed by filtration, washing with water and drying to give a polymerization toner. The toner thus obtained had a particle diameter of 8.5 μm as weight average diameter and had a sharp particle size distribution. It also had an endothermic peak top temperature of 70° C., measured using a DSC.

To 100 parts by weight of the toner thus obtained, 0.7 part of hydrophobic silica having a BET surface specific area of 200 m$^2$ was externally added. To 7 parts by weight of this toner, 93 parts by weight of an acrylic resin-coated ferrite carrier was mixed to give a developer.

Using this developer, images were reproduced on a full-color copying machine CLC-500, manufactured by Canon Inc. Results obtained are shown in Table 1.

EXAMPLE 2

Example 1 was repeated to give a polymerization toner, except that the amount of evaporated water corresponds to 150% by weight of the suspension. The toner thus obtained had a particle diameter of 8.7 μm as weight average diameter and had a sharp particle size distribution. It had an endothermic peak top temperature of 70° C., measured using a DSC.

A developer was prepared in the same manner as in Example 1 and images were also reproduced. Results obtained are shown in Table 1.

EXAMPLE 3

Example 1 was repeated to give a polymerization toner, except that the amount of the evaporated water corresponds to 50% by weight of the suspension. The toner thus obtained had a particle diameter of 8.3 μm as weight average diameter and had a sharp particle size distribution. It had an endothermic peak top temperature of 70° C., measured using a DSC.

A developer was prepared in the same manner as in Example 1 and images were also reproduced. Results obtained are shown in Table 1.

EXAMPLE 4

Example 1 was repeated to give a polymerization toner, except that the amount of evaporated water corresponds to 5% by weight of the suspension. The toner thus obtained had a particle diameter of 8.4 μm as weight average diameter and had a sharp particle size distribution. It had an endothermic peak top temperature of 70° C., measured using a DSC.

A developer was prepared in the same manner as in Example 1 and images were also reproduced. Results obtained are shown in Table 1.

EXAMPLE 5

Example 1 was repeated to give a polymerization toner, except that the paraffin wax was used in an amount of 100 g, no sonication was applied during the evaporation of water, the amount of evaporated water corresponds to 50% by weight of the suspension, and the operation was carried out under reduced pressure of 200 mmHg and in an oil bath at temperature of 140° C. The toner thus obtained had a particle diameter of 8.5 μm as weight average diameter and had a sharp particle size distribution. It had an endothermic peak top temperature of 70° C., measured using a DSC.

A developer was prepared in the same manner as in Example 1 and images were also reproduced. Results obtained are shown in Table 1.

EXAMPLE 6

Example 1 was repeated to give a polymerization toner, except that the water was evaporated under normal pressure and the amount corresponds to 50% by weight of the suspension. The toner thus obtained had a particle diameter of 8.6 μm as weight average diameter and had a sharp particle size distribution. It had an endothermic peak top temperature of 70° C., measured using a DSC.

A developer was prepared in the same manner as in Example 1 and images were also reproduced. Results obtained are shown in Table 1.

EXAMPLE 7

Example 1 was repeated to give a polymerization toner, except that no sonication was applied. The toner thus obtained had a particle diameter of 8.5 μm as weight average diameter and had a sharp particle size distribution. It had an endothermic peak top temperature of 70° C., measured using a DSC.

A developer was prepared in the same manner as in Example 1 and images were also reproduced. Results obtained are shown in Table 1.

COMPARATIVE EXAMPLE 1

Example 1 was repeated to give a polymerization toner, except that it was carried out under normal pressure without sonication and without water evaporation. The toner thus obtained had a particle diameter of 8.4 μm as weight average diameter and had a sharp particle size distribution. It had an endothermic peak top temperature of 70° C., measured using a DSC.

A developer was prepared in the same manner as in Example 1 and images were also reproduced. Results obtained are shown in Table 1.

COMPARATIVE EXAMPLE 2

Example 3 was repeated to give a polymerization toner, except that the water was evaporated to an amount corresponding to 50% by weight of the suspension without supplying water. The toner thus obtained had partly coalesced and had a broad particle size distribution. The toner was partly melt-adhered to the wall of the reaction vessel. It had an endothermic peak top temperature of 70° C., measured using a DSC.

A developer was prepared in the same manner as in Example 3 and images were also reproduced. Results obtained are shown in Table 1.

COMPARATIVE EXAMPLE 4

Example 5 was repeated to give a polymerization toner, except that it was carried out without reducing pressure and the water was evaporated at a liquid temperature of 95° C. without supplying water and the evaporated water amounted to 50% by weight of the suspension. The toner thus obtained had partly coalesced and had a broad particle size distribution. The toner was partly melt-adhered to the wall of the reaction vessel.

A developer was prepared in the same manner as in Example 3 and images were also reproduced. Results obtained are shown in Table 1.

TABLE 1

| | Particle size[1)] distribution | Offensive odor[2)] during fixing | Image[3)] quality |
|---|---|---|---|
| Example: | | | |
| 1 | AA | AA | AA |
| 2 | AA | AA | AA |
| 3 | AA | A | A |
| 4 | AA | B | A |
| 5 | AA | AA | AA |
| 6 | AA | B | A |
| 7 | AA | B | A |
| Comparative Example: | | | |
| 1 | AA | C | B |
| 2 | C | — | — |
| 4 | C | — | — |

[1)]Particle size distribution:
AA: Good.
A: No difficulty in practical use.
B: Lower limits in practical use.
C: Unpassable in practical use.
[2)]Offensive odor during fixing: Offensive odor produced when solid images were fixed on 100 copy sheets:
AA: No offensive odor.
A: Very slight odor.
B: Slight offensive odor.
C: Offensive odor.
[3)]Image quality:
AA: Good
A: No difficulty in practical use.
B: Lower limits in practical use.

EXAMPLE 8

Into 709 g of ion-exchanged water, 451 g of an aqueous 0.1M-$Na_3PO_4$ solution was introduced, and the mixture was heated to 60° C. Thereafter 67.7 g of an aqueous 0.1M-$CaCl_2$ solution was added thereto little by little to give an aqueous medium containing $Ca_3(PO_4)_2$.

Following formulation:

| | |
|---|---|
| Styrene | 170 g |
| 2-Ethylhexyl acrylate | 30 g |
| C.I. Pigment Blue 15:3 | 10 g |
| Styrene-methacrylic acid-methyl methacrylate (85:5:10) copolymer (molecular weight Mw: 58,000) | 5 g |
| Paraffin wax (m.p.: 70° C.) | 30 g |
| Di-tert-butylsalicylic acid chromium complex | 5 g |

was heated to 60° C., and was uniformly dissolved and dispersed with stirring at 12,000 rpm using a TK-type homomixer (manufactured by Tokushu Kika Kogyo Co., Ltd.). As polymerization initiators, 10 g of 2,2'azobis(2,4-dimethylvaleronitrile) [t ½: 140 min, at 60° C.] and 1 g of dimethyl 2,2'-azobisisobutyrate [t ½: 1,270 min. at 60° C.; t ½: 80 min. at 80° C.] were dissolved to prepare a polymerizable monomer system. The polymerizable monomer system was introduced into the above aqueous medium, followed by stirring using the TK homomixer at 10,000 rpm for 20 minutes at 60° C. in an atmosphere of $N_2$ to carry out granulation to form suspension droplets corresponding to toner particle size. Thereafter, while stirring with paddle stirring blades, the reaction was carried out at 60° C. for 4 hours. At this stage, the polymerization conversion rate was 95%. Thereafter, the reflux of water vapor was stopped and the liquid temperature was raised to 80° C. and the open space of the reaction vessel was made open to the atmosphere. Then, controlling the amount of water to be evaporated to 5 g per minute, 100° C. water vapor was fed from the outside through a porous ceramic tube having a close end, and the reaction was continued for further 10 hours. After the reaction was completed, the suspension was cooled, hydrochloric acid was added to dissolve the $Ca_3(PO_4)_2$, followed by filtration, washing with water and drying to give a polymerization toner with a weight average particle diameter of 8.2 μm (coefficient of variation [average diameter/standard deviation×100%]: 23.4%). At this stage, the polymerizable monomers remaining in the toner was 90 ppm.

To 100 parts by weight of the toner thus obtained, 0.7 part of hydrophobic silica having a BET surface specific area of 200 $m^2$ was externally added. To 7 parts by weight of this toner, 93 parts by weight of an acrylic resin-coated ferrite carrier was mixed to give a developer.

Using this developer, images were reproduced on a full-color copying machine CLC-500, manufactured by Canon Inc. Sharp and high-density images were obtained. Fixing was carried out in a good performance and no offset phenomenon was seen. The developer was left to stand for a month in an environment of temperature 35° C. and humidity 80% RH, but images again reproduced had a high image quality as that of the initial images. During the fixing, no smell of styrene was emitted, and neither filming phenomenon on the photosensitive drum nor blocking phenomenon of the toner was seen even after images were reproduced on 10,000 copy sheets.

COMPARATIVE EXAMPLE 5

Example 8 was repeated without feeding water, to give a toner having a weight average particle diameter of 8.3 μm (coefficient of variation 24.1%). The polymerizable monomers remaining in the toner was in a quantity of 2,350 ppm. Using this toner, a developer was prepared in the same manner as in Example 8 and images were reproduced. As a result, images as good as those in Example 8 were obtained. However, smell of styrene was emitted from around the fixing assembly. This toner was left to stand for a month in an environment of temperature 35° C. and humidity 80% RH. As a result, the quantity of triboelectricity of the toner decreased and when images were again reproduced, fog phenomena increased. Images were further reproduced on 10,000 copy sheets. As a result, a filming phenomenon was slightly seen on the photosensitive drum and the sharpness of images decreased.

COMPARATIVE EXAMPLE 6

In Comparative Example 5, the temperature was raised to 100° C. after the polymerization was completed, and the water was evaporated by 50%. Thereafter, the subsequent procedure in Example 8 was followed to give a polymerized toner. The remained polymerizable monomers was 80 ppm. Although the offensive odor was hardly emitted during fixing, the toner had a particle size as coarse as 12.4 μm in weight average particle diameter (variation coefficient: 33.8%), resulting in a lowering of resolution.

COMPARATIVE EXAMPLE 7

In Example 8, dry $N_2$ gas of 100° C. was blown in place of the water vapor. There was no effect when the gas is fed at such a flow rate enough to replace oxygen during the polymerization reaction. As the rate of feeding was increased, the suspension began to bubble and polymerization products began to adhere to the wall. The bubbles did not easily disappear even when the feeding of gas was stopped, and the resulting toner included many coarse particles, so that its blocking temperature dropped by 5° C. and the fluidity became poor.

EXAMPLE 9

In Example 8, the pressure was reduced to 500 mmHg and the water was evaporated at the rate of 10 g/min. The toner of the same quality was obtained in a half operation time. There was no influence on particle size and toner performance. As in Example 8, a good toner was obtained.

EXAMPLE 10

The same polymerizable monomer system as in Example 8 was introduced into the same aqueous medium as in Example 8, followed by stirring using the TK homomixer at 10,000 rpm for 20 minutes at 60° C. in an atmosphere of $N_2$ to carry out granulation to form suspension droplets corresponding to toner particle size. Thereafter, with stirring with paddle stirring blades, the reaction was carried out at 60° C. for 4 hours. At this stage, the polymerization conversion rate was 95%. Thereafter, the reflux of water vapor was stopped and the liquid temperature was raised to 80° C. and the open space of the reaction vessel was made open to the atmosphere. Then, while controlling the amount of feeding so as for bubbles not to disappear halfway, totally 500 g of propyl alcohol vapor of 94° C. was fed through a porous ceramic tube having a close end, and the reaction was continued for further 5 hours. After the reaction was completed, the suspension was cooled, hydrochloric acid was added to dissolve the $Ca_3(PO_4)_2$, followed by filtration, washing with water and drying to give a polymerization toner with a weight average particle diameter of 7.9 μm (variation coefficient [average diameter/standard deviation×100%]: 24.0%). At this stage, the polymerizable monomers remaining in the toner was 70 ppm.

To 100 parts by weight of the toner thus obtained, 0.7 part of hydrophobic silica having a BET surface specific area of 200 $m^2$ was externally added. To 7 parts by weight of this toner, 93 parts by weight of an acrylic resin-coated ferrite carrier was mixed to give a developer.

Using this developer, images were reproduced on a full-color copying machine CLC-500, manufactured by Canon Inc. Sharp and high-density images were obtained. Fixing was carried out in a good performance and no offset phenomenon was seen. This developer was left to stand for a month in an environment of temperature 35° C. and humidity 80% RH, but images again reproduced had a image quality as good as that of the initial images. During the fixing, no smell of styrene was emitted, and neither filming phenomenon on the photosensitive drum nor blocking phenomenon of the toner was seen even after images were reproduced on 10,000 copy sheets.

COMPARATIVE EXAMPLE 8

Example 10 was repeated except that no propyl alcohol vapor was fed and the stirring time was extended for 5 hours, to give a toner with a weight average particle diameter of 8.3 μm (variation coefficient: 24.1%). The polymerizable monomers remaining in the toner was in a quantity of 2,350 ppm. Using this toner, a developer was prepared in the same manner as in Example 8 and images were reproduced. As a result, images as good as those in Example 8 were obtained. However, smell of styrene was emitted from the fixing assembly. This toner was left to stand for a month in an environment of temperature 35° C. and humidity 80% RH. As a result, the quantity of triboelectricity of the toner decreased and when images were again reproduced fogging increased. Images were further reproduced on 10,000 copy sheets. As a result, a filming phenomenon was slightly seen on the photosensitive drum and the sharpness of images decreased.

COMPARATIVE EXAMPLE 9

In Comparative Example 8, the temperature was raised to 100° C. after the polymerization was completed and the water was evaporated by 50%. Thereafter, the subsequent procedure in Example 10 was repeated to give a polymerization toner in which the polymerizable monomers remained in a quantity of 80 ppm. Although the offensive odor was little emitted during fixing, the toner had a particle size as coarse as 12.3 μm in weight average particle diameter (variation coefficient: 33.8%), resulting in a lowering of resolution.

COMPARATIVE EXAMPLE 10

In Example 10, dry $N_2$ gas of 100° C. was blown in place of the propyl alcohol vapor. There was no effect when the gas is fed at such a flow rate enough to replace oxygen during polymerization reaction. As the feeding rate was increased, the suspension began to bubble and polymerization products began to adhere to the wall. The bubbles did not easily disappear even when the feeding of gas was stopped, and the resulting toner included many coarse particles, so that its blocking temperature dropped by 5° C. and its fluidity became poor.

What is claimed is:

1. A process for producing toner particles, comprising the steps of;

introducing into a first aqueous medium a polymerizable monomer composition containing a polymerizable monomer, to carry out granulation;

subjecting particles of the granulated polymerizable monomer composition to polymerization reaction;

adding to the reaction system a member selected from the group consisting of a second aqueous medium, a water-soluble solvent and a water-soluble gas; and evaporating from the reaction system the remaining polymerizable monomer, and the first aqueous medium, at the latter half of polymerization reaction or after the completion of polymerization reaction, whereby the remaining polymerizable monomer is removed from the particles.

2. The process according to claim 1, wherein the remaining polymerizable monomer and the first aqueous medium are evaporated under reduced pressure, under sonication, or under reduced pressure and sonication.

3. The process according to claim 1, wherein the remaining polymerizable monomer and the first aqueous medium are evaporated while heating at a temperature higher than the top temperature of endothermic peaks as measured using a differential scanning calorimeter.

4. The process according to claim 1, wherein the first aqueous medium is evaporated in a quantity of 5% by weight to 100% by weight on the basis of the quantity of the reaction system.

5. The process according to claim 1, wherein the addition of said member to said reaction system and the evaporation of the remaining polymerizable monomer and the first aqueous medium are carried out when the polymerization conversion rate has reached at least 90%.

6. The process according to claim 1, wherein said water-soluble solvent comprises a lower alcohol or a lower ketone.

7. The process according to claim 1, wherein said water-soluble solvent comprises methanol, ethanol, propanol or acetone.

8. The process according to claim 1, wherein said water-soluble gas comprises an acidic gas or a basic gas.

9. The process according to claim 1, wherein said water-soluble gas comprises carbonic acid gas or ammonia gas.

10. The process according to claim 1, wherein said polymerizable monomer composition comprises a monomer selected from the group consisting of a styrene monomer, an acrylate monomer, a methacrylate monomer, an acrylonitrile monomer, a methacrylonitrile monomer and an acrylamide.

11. The process according to claim 1, wherein said polymerizable monomer composition contains a resin having a polar group.

12. The process according to claim 1, wherein said polymerizable monomer composition contains a cationic polymer selected from the group consisting of a polymer of nitrogen-containing monomers, a copolymer of a nitrogen-containing monomer with a styrene monomer and a copolymer of a nitrogen-containing monomer with an unsaturated carboxylic acid ester.

13. The process according to claim 1, wherein said polymerizable monomer composition contains an anionic polymer selected from the group consisting of a polymer of nitrile monomers, a polymer of halogen-containing monomers, a polymer of unsaturated carboxylic acid monomers, a polymer of unsaturated dibasic acid monomers, a polymer of an unsaturated dibasic acid anhydride monomer, a polymer of nitro monomer, a copolymer of nitrile monomer with a styrene monomer, a copolymer of a halogen-containing monomer with a styrene monomer, a copolymer of an unsaturated carboxylic acid monomer with a styrene monomer, a copolymer of an unsaturated dibasic acid monomer with a styrene monomer, a copolymer of an unsaturated dibasic acid anhydride monomer with a styrene monomer and a copolymer of a nitro monomer with a styrene monomer.

14. The process according to claim 1, wherein said polymerizable monomer composition contains a component selected from the group consisting of a low-molecular weight polymer, a plasticizer, a liquid rubber, a low-temperature fluidizing component and a low-surface energy material.

15. The process according to claim 1, wherein said reaction system contains the first aqueous medium in an amount of from 300 parts by weight to 3,000 parts by weight based on 100 parts by weight of said polymerizable monomer composition.

16. The process according to claim 1, wherein the first aqueous medium contains a surface active agent, an organic dispersant or an inorganic dispersant.

17. The process according to claim 1, wherein the first aqueous medium contains a phosphoric acid polyvalent metal salt, a carbonate, an inorganic salt or an inorganic oxide.

18. The process according to claim 1, wherein the first aqueous medium contains an inorganic dispersant in an amount of from 0.2 part by weight to 20 parts by weight based on 100 parts by weight of said polymerizable monomer.

19. The process according to claim 16, wherein said inorganic dispersant is formed into particles in said first aqueous medium.

20. The process according to claim 1, wherein the first aqueous medium contains sodium dodecylbenzenesulfate, sodium tetradecylsulfate, sodium pentadecylsulfate, sodium octylsulfate, sodium oleate, sodium laurate, sodium stearate or potassium stearate.

21. The process according to claim 1, wherein polymerizable monomers remaining in said toner are controlled to be not more than 1,000 ppm.

22. The process according to claim 1, wherein polymerizable monomers remaining in said toner are controlled to be not more than 100 ppm.

23. The process according to claim 1, wherein the addition of said member to said reaction system and the evaporation of the remaining polymerizable monomer, the first aqueous medium and said member are carried out at the same time.

24. The process according to claim 1, wherein the first aqueous medium and the second aqueous medium are the same.

25. The process according to claim 1, wherein said member is a liquid of the second aqueous medium.

26. The process according to claim 1, wherein said member is a vapor of said second aqueous medium.

27. The process according to claim 1, wherein said member is a vapor of the water-soluble solvent.

28. The process according to claim 1, wherein said member is a saturated vapor of the second aqueous medium.

29. The process according to claim 1, wherein said member is a saturated vapor of the water-soluble solvent.

30. The process according to claim 1, wherein said member is a liquid of the second aqueous medium, and the addition of said member to the reaction system and the evaporation of the remaining polymerizable monomer and the first aqueous medium are carried out at the same time after the completion of the polymerization reaction.

31. The process according to claim 1, wherein said member is a liquid of the second aqueous medium, and the addition of said member to the reaction system and the evaporation of the remaining polymerizable monomer and the first aqueous medium are carried out at the same time after the completion of the polymerization reaction under reduced pressure, under sonication, or under reduced pressure and sonication.

32. The process according to claim 1, wherein said member is a saturated vapor of the second aqueous medium, and the addition of said member to the reaction system and the evaporation of the remaining polymerizable monomer and the first aqueous medium are carried out at the same time.

33. The process according to claim 1, wherein said member is a vapor of the water-soluble solvent, and the addition of said member to the reaction system and the evaporation of the remaining polymerizable monomer and the first aqueous medium are carried out at the same time.

34. The process according to claim 1, wherein said member is a water soluble gas, and the addition of said member to the reaction system and the evaporation of the remaining polymerizable monomer and the first aqueous medium are carried out at the same time.

35. The process according to claim 1, wherein said added member is evaporated with the remaining polymerizable monomer and the first aqueous medium from the reaction system.

36. The process according to claim 1, wherein said member is the second aqueous medium, and a mixture of the first aqueous medium and said second aqueous medium is evaporated in a quantity of 5% by weight to 100% by weight on the basis of the quantity of the reaction system.

* * * * *

UNITED STATES PATENT AND TRADEMARK OFFICE

CERTIFICATE OF CORRECTION

PATENT NO. : 5,476,745

DATED : December 19, 1995

INVENTOR(S) : TATSUYA NAKAMURA ET AL.

It is certified that error appears in the above-indentified patent and that said Letters Patent is hereby corrected as shown below:

COLUMN 1

Line 42, "size" should read --sizes--.
Line 44, "Consequently" should read --Consequently,--.

COLUMN 2

Line 54, "ings" should read --ing--;
Line 59, "effect" should read --affect--.

COLUMN 3

Line 58, "of;" should read --of:--.

COLUMN 5

Line 19, "can not" should read --cannot--;
Line 20, "reduced the" should read --reduced, on the--.

UNITED STATES PATENT AND TRADEMARK OFFICE

CERTIFICATE OF CORRECTION

PATENT NO. : 5,476,745

DATED : December 19, 1995

INVENTOR(S) : TATSUYA NAKAMURA ET AL.

It is certified that error appears in the above-indentified patent and that said Letters Patent is hereby corrected as shown below:

COLUMN 8

Line 12, "granularion." should read --granulation.--.

COLUMN 10

Line 66, "to Above" should read --to 90%. Above--.

COLUMN 11

Line 2, "of or" should read --of 95% or--.

COLUMN 18

Line 3, "of;" should read --of:--.

Signed and Sealed this

Fourteenth Day of May, 1996

*Attest:*

Bruce Lehman

BRUCE LEHMAN

*Attesting Officer*

*Commissioner of Patents and Trademarks*